US006142670A

United States Patent [19]

Kramer

[11] Patent Number: 6,142,670

[45] Date of Patent: Nov. 7, 2000

[54] SHOEBAG HAVING A PROTECTIVE FLAP FOR PREVENTING THE DAMAGE OF PROPERTY AND METHOD THEREFOR

[76] Inventor: Curtis G. Kramer, 6700 E. Russell, #236, Las Vegas, Nev. 89122

[21] Appl. No.: 09/315,227

[22] Filed: May 20, 1999

[51] Int. Cl.[7] ..... B65D 33/06

[52] U.S. Cl. ..... 383/6; 383/127; 206/315.1

[58] Field of Search ..... 383/4, 38, 39, 383/6, 127; 224/153, 539, 563; 206/315.1

[56] References Cited

U.S. PATENT DOCUMENTS

| | | | |
|---|---|---|---|
| 4,154,323 | 5/1979 | Sneider | 383/4 X |
| 4,830,154 | 5/1989 | Gerch et al. | 190/103 |
| 4,854,637 | 8/1989 | McCree | 297/188 |
| 4,974,709 | 12/1990 | Furlow et al. | 190/102 |
| 5,120,108 | 6/1992 | Watson et al. | 383/4 X |
| 5,228,547 | 7/1993 | Yoo | 206/315.1 X |
| 5,439,153 | 8/1995 | Murdoch et al. | 383/4 X |
| 5,588,529 | 12/1996 | Speck | 206/315.1 |
| 5,620,227 | 4/1997 | Brune | 297/4 |
| 5,988,465 | 11/1999 | Vitale et al. | 224/153 X |

*Primary Examiner*—Jes F. Pascua

*Attorney, Agent, or Firm*—Jeffrey Weiss; Jeffrey D. Moy; Weiss & Moy, P.C.

[57] ABSTRACT

A container for storing shoes having cleats/spikes uses a shoe bag for storing the shoes having one of cleats or spikes. A protective flap is coupled to the shoe bag and is used to protect a surface of an object from being damaged by a bottom portion of the shoes when the shoes are placed on top of the protective flap when an individual is putting on the shoes.

3 Claims, 1 Drawing Sheet

SHOEBAG HAVING A PROTECTIVE FLAP FOR PREVENTING THE DAMAGE OF PROPERTY AND METHOD THEREFOR

BACKGROUND OF THE INVENTION

1. Field of the Invention

This invention relates to athletic equipment and methods therefor and, more specifically, to a shoebag which has a protective flap which prevents shoes having cleats and spikes from damaging property when a person is putting on the shoes.

2. Description of the Prior Art

Because of the desire to relieve stress and to become physically fit, many people are participating in different types of sporting activities. Since a majority of the sporting activities require different types of sports equipment, many individuals have purchased sporting good bags to carry the different types of equipment to each of the different sporting activities. Over the years sporting good manufacturers have developed specialty bags to carry specific types of sporting good equipment. For example, sporting good bags have been designed to the specific size and shape to carry one or more tennis rackets, baseball and softball bats, hockey equipment, and the like. Equipment bags have also been designed to specifically hold the shoes for different sporting activities.

Many sporting activities require shoes that have cleats or spikes. The cleats/spikes are used to help the individual obtain better traction on the playing field. When placing the cleats/spikes on the user's feet, the user generally places his/her feet on an elevated platform such as a car bumper, bleachers near the playing field, and the like. The user does this so that he/she does not have to bend down as far in order to tie his/her shoes. Unfortunately, the cleats/spike have a tendency to damage the elevated platform by scraping and/or puncturing the surface of the platform.

Therefore, a need existed to provide an improved sports equipment bag. The improved sports equipment bag must be able to store shoes having cleats/spikes. The improved sports equipment bag must further have a protective flap to protect surfaces from being damaged from the cleats/spikes when an individual places the shoes on the surface of an object in order to tie his/her shoes.

SUMMARY OF THE INVENTION

In accordance with one embodiment of the present invention, it is an object of the present invention to provide an improved sports equipment bag.

It is another object of the present invention to provide an improved sports equipment bag that is able to store shoes having cleats/spikes.

It is still another object of the present invention to provide an improved sports equipment bag that is able to store shoes having cleats/spikes and which further has a protective flap to protect surfaces from being damaged from the cleats/spikes when an individual places the shoe on the surface of an object in order to tie his/her shoes.

BRIEF DESCRIPTION OF THE PREFERRED EMBODIMENTS

In accordance with one embodiment of the present invention, a container for storing shoes is disclosed. The container uses a shoe bag for storing shoes having one of cleats or spikes. A protective flap is coupled to the shoe bag. The protective flap is used for protecting a surface of an object from being damaged by a bottom portion of the shoes when the shoes are placed on top of the object when an individual is putting on the shoes.

In accordance with another embodiment of the present invention, a method for a method of providing a container for storing shoes is disclosed. The method comprises the steps of: providing a shoe bag for storing shoes having one of cleats or spikes; and providing a protective flap coupled to the shoe bag for protecting a surface of an object from being damaged by a bottom portion of the shoes when the shoes are placed on the object when an individual is putting on the shoes.

The foregoing and other objects, features, and advantages of the invention will be apparent from the following, more particular, description of the preferred embodiments of the invention, as illustrated in the accompanying drawing.

DETAILED DESCRIPTION OF THE PREFERRED EMBODIMENT

Figure 1:
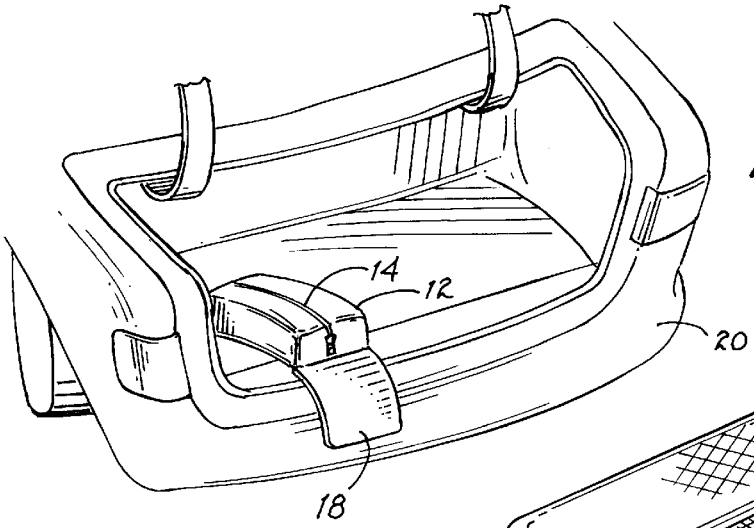
FIG. 1 is an elevated perspective view of the present invention in use to protect the rear bumper of an automobile.
Figure 2:
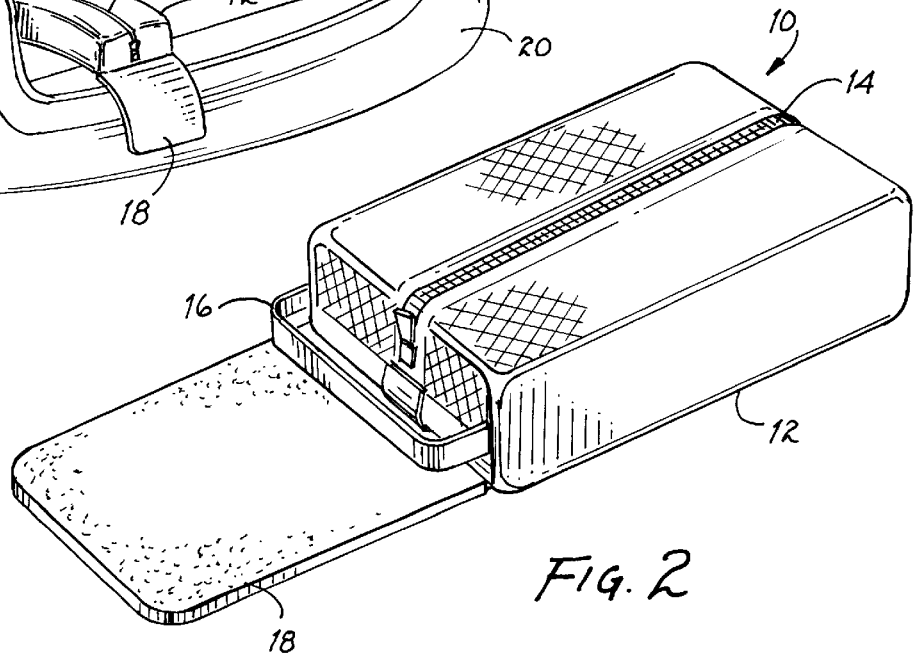
FIG. 2 is a closeup elevated perspective view of the improved shoebag depicted in FIG. 1.
Figure 3:
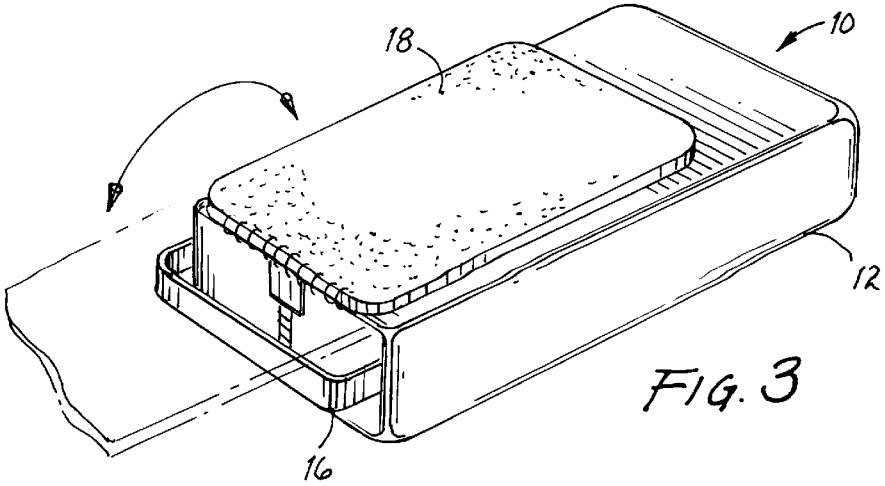
FIG. 3 is an elevated bottom view of the shoebag depicted in FIG. 3 with the protective flap folded against the bottom of the shoebag.

Referring to FIGS. 1–3, a sports equipment bag 10 (hereinafter bag 10) is shown. The bag 10 is designed to serve two main functions. First, the bag 10 is used for storing shoes. In the preferred embodiment of the present invention, the bag 10 is used to store shoes having one of cleats or spikes. The bag 10 is further designed to protect a surface of an object from being damages by a bottom portion (i.e. the area where the cleats/spikes are located) of the shoes. This is accomplished by placing a section of the bag 10 over the object prior to the individual placing the shoes on top of the object when the individual is putting on the shoes.

The bag 10 uses a standard size shoebag 12 for storing and transporting a pair of shoes (not shown). As stated above, the shoes are, in general, a pair of athletic shoes having one of cleats or spikes. The shoebag 12 is preferably made out of a light weight durable material. For examples, the shoebag 12 may be made out of nylon, plastic, cotton or polyester cloth, and the like. It should be noted that the above listed materials only serve as examples and should not be seen as to limit the scope of the patent. The shoebag 12 may further have one or more mesh sections, or may be made entirely out of a strong durable mesh material. The mesh material will allow outside air to circulate around the stored shoes thereby preventing a musty odor from building up in the shoebag 12.

An opening/closing mechanism 14 is coupled to the shoebag 12. The mechanism 14 is used to open and close the shoebag 12 thereby allowing an individual to remove and safely store the shoes in the shoebag 12. The mechanism 14 may be a zipper, buttons, hook and loop material, drawstring, and the like. It should be noted that the examples listed for the mechanism 14 only serve as examples and should not be seen to limit the scope of the patent. A handle 16 may further be coupled to the shoebag 12. The handle 16 is used to carry the bag 10 to the different sporting activities.

A protective flap 18 is also coupled to the shoebag 12. In the preferred embodiment of the present invention, the protective flap 12 is hingly coupled to the shoebag 12. This will allow the protective flap 12 to be folded back and to rest against a back section of the shoebag 12. A connector may be used to hold the protective flap 12 against the back of the shoebag 12 when the protective flap 12 is folded back and not in use. The connector may be a double side adhesive tape, hook and loop material, a grommet connector, and the like. Once again, the examples list for the connector only serve as examples and should not be seen as to limit the scope of the patent.

The protective flap 18 is used to protect a surface of an object from being damaged by a bottom portion of shoes (i.e., the portion of the shoes having the spikes/cleats) when an individual is putting on the shoes. For examples, many golfers put their golf shoes on at the car when they arrive at the golf course. When placing their golf shoes on their feet, the user generally places his/her feet on an elevated platform such as the car bumper 20 (see FIG. 1). The user does this so that he/she does not have to bend down as far in order to tie his/her shoes. Unfortunately, the spikes on the golf shoes have a tendency to damage the bumper 20 by scraping and/or puncturing the surface of the bumper 20. If the golfer uses the protective flap 18 to cover a section of the bumper 20, the golfer may place his/her golf shoes on top of the protective flap 18 in order to tie his/her shoes. The protective flap 18 is of sufficient thickness to prevent the spikes on the golf shoe from damaging the bumper 20 of the car. In the preferred embodiment of the present invention, the protective flap 18 is made out of a cushiony, skid resistant material like foam rubber.

The protective flap 18 may further be used by baseball, football, soccer, or softball players to protect the bleachers or chairs from being damaged when these players use the bleachers or chairs to put on their cleats. The example usages cited above are only listed for illustrative purposes and should not be seen as to limit the scope of the patent. The protective flap 18 may be used by any individual to protect the surface of any object when the individual places the shoes on top of the object when putting on his/her shoes.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method of protecting a surface of an object from being damaged comprising, in combination, the steps of:

providing a substantially rectangular shoe bag adapted to receive shoes having one of cleats and spikes, wherein said shoe bag has a top surface, a bottom surface, a first end joining a first edge of said top surface to a first edge of said bottom surface, and a second end joining a second edge of said top surface to a second edge of said bottom surface;

providing a protective flap having a top surface and a bottom slip resistant surface and a substantially linear edge, wherein substantially all of said substantially linear edge is hingedly coupled to said shoe bag proximate one of said first edge of said bottom surface and said second edge of said bottom surface;

placing said protective flap on a surface of an object to protect said surface from being damaged by said shoes having said one of cleats and spikes;

placing said shoes on said protective flap;

removing said shoes from feet; and inserting said shoes into said shoe bag.

2. The method of claim 1 wherein said protective flap further comprises the step of providing an elongated piece of puncture resistant cushion material.

3. The method of claim 1 wherein said shoe bag further comprises the step of providing a handle for carrying said container.

* * * * *